United States Patent [19]

Mayer

[11] 3,997,220

[45] Dec. 14, 1976

[54] DISPLAY UNITS

[76] Inventor: Raymond E. Mayer, 88 Salem Road, Schwenksville, Pa. 19473

[22] Filed: June 23, 1975

[21] Appl. No.: 589,621

[52] U.S. Cl. ..... 312/242; 312/204; 312/234

[51] Int. Cl.[2] ..... A47B 81/00

[58] Field of Search ..... 312/223, 138 A, 234, 312/234.4, 242, 204

[56] References Cited

UNITED STATES PATENTS

| | | | |
|---|---|---|---|
| 953,803 | 4/1910 | Sellers | 312/242 |
| 1,536,906 | 5/1925 | Miller | 312/242 |
| 1,912,902 | 6/1933 | Kramer | 312/223 |
| 1,978,205 | 10/1934 | Ide | 312/223 |
| 2,559,371 | 7/1951 | Ressinger | 312/223 |
| 2,630,187 | 3/1953 | Loreto | 312/242 |
| 2,820,686 | 1/1958 | Snyder | 312/223 |
| 3,405,985 | 10/1968 | Higer | 312/242 |
| 3,429,630 | 2/1969 | Katz | 312/242 |
| 3,437,057 | 4/1969 | Wulff | 312/242 |
| 3,450,454 | 6/1969 | Anders | 312/223 |

*Primary Examiner*—Paul R. Gilliam
*Assistant Examiner*—Victor N. Sakran
*Attorney, Agent, or Firm*—Frederick J. Olsson

[57] ABSTRACT

Basic components of unit are: 4 × 8 foot panel supported to stand in an upright position: openings or cutouts in the panel; each opening contains a pop-in/pop-out molded plastic display tray for storing and/or displaying articles. Panels have quick connect/disconnect fasteners for joining. As used in a retail store, the unit simulates a wall and forms visible, accessible display means.

6 Claims, 6 Drawing Figures

DISPLAY UNITS

This invention relates in general to store fixtures and displays and in particular relates to a composite wall simulating and merchandise display unit.

This invention finds particular utility for newly constructed and/or rennovated stores particularly stores or outlets where visible merchandise displays are necessary for relatively small items such as hardware, shoes, clothing, accessories, millinery, jewelry, eye wear, small appliances, books, auto parts, cosmetics, toiletries, ceramics, drugs, medicines and the like.

The invention contemplates a 4 foot × 8 foot panel having a decorative surface on one or both faces, the panel being provided with one or more cutouts, with each cutout adapted to receive a plastic display tray. The tray is put into position in a cutout simply by pushing the same into the cutout and can be changed to another type tray simply by pulling or pushing out. The edges of the panels are provided with quick connect-disconnect fasteners so that the panels can be joined together and also joined to supports which hold the panels upright on a floor.

One of the principal advantages of the invention is cost reduction. This is accomplished by that the finishing for interior walls can be the most inexpensive kind without sacrificing decor and by that the need for expensive display cabinets and fixtures is eliminated. Moreover the same basic structure is used in a multiplicity of different display and wall simulating applications so that inventory is held to a minimum.

Another principal advantage of the invention is versatility. Units of the invention are adaptable for all normally used display applications. Moreover the invention allows for creative nd wide innovation in developing displays to attract customers. The same basic structure is used in all configurations necessary for achieving the foregoing.

The invention will be described below in connection with the following drawings therein:

While I will describe the invention primarily in terms of merchandise display units for stores and similar outlets it will be understood that the invention has wide uses in other areas. For example, in the home for bookshelves, knick-knacks, spice compartments, grocery shelves, junk shelves and other like storage areas. In offices the invention can be adapted for book shelves and as quick access storage areas for various types of small office equipment. In commercial establishments and in industrial plants, for example, in lobbys or waiting rooms the units can be adapted to hold various items which are manufactured by the particular organization and/or to hold magazines, trade publications and the like. Since the units of the invention are dismountable and washable the same are readily adaptable for use in hospitals and clinics for storing and displaying a wide variety of items.

Figure 1:
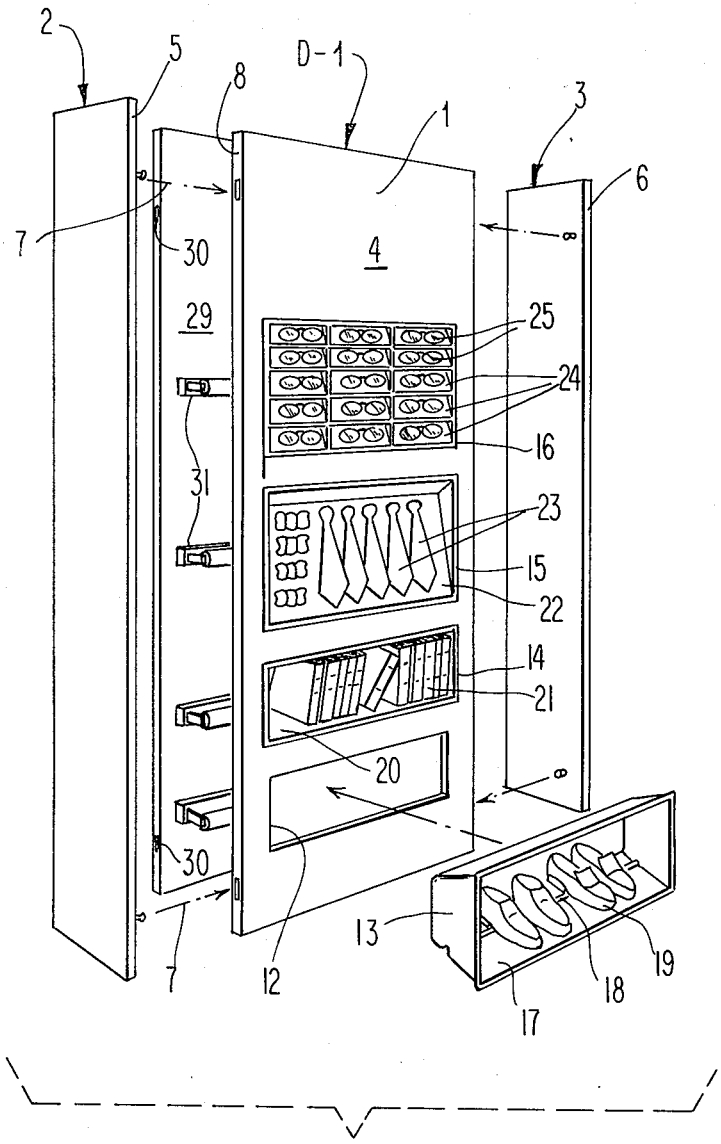
FIG. 1 is an exploded view illustrating the basic components of the invention arranged in a single, free standing unit.

The display unit D-1 of FIG. 1 includes a 4 × 8 foot (standard size) main panel 1 and support panels 2 and 3. The preferred material for panel 1 is ¾ inch particle board having a melamine, vinyl or polyester surface on both faces, one face having a decorative design and the other a color surface. This permits either side to be the visible or the front face 4 (which is viewed by a customer).

The panels 2 and 3 are made from a panel such as panel 1 cut into sections. The visible edges such as 5 and 6 of the panels 2 and 3 are covered with compatible tape, wooden metal or plastic laminate facing material.

Quick, connect-disconnect fastener means join the panel 1 to support means (or to abutting panels). In the present instance the panel 1 is joined to the support panels 2 and 3 as by the fasteners 7.

Figure 2:
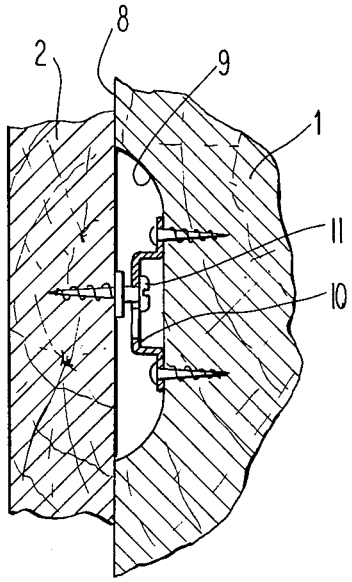
FIG. 2 is a sectional view of a typical quick connect-/disconnect fastener for two abutting panels.

A quick connect/disconnect fastener 7 is shown in detail FIG. 2. The edge 8 of the panel 1 is routed out at 9 to receive the bridge 10 which has a key-hold aperture for receiving the shoulder screw 11 mounted on a face support panel 2. This type of fastener is manufactured by Modular Systems Inc., Freeport, Mich.

While particle board of the kind mentioned is preferred, it will be understood that the invention is applicable for relatively thin panels such as those made from plywood. In such cases, furring strips are set up on the backside of the panel adjacent the opposite lengthwise edges. The furring strips are routed out to receive the bridges and the shoulder screws are placed in the side supports. The principal disadvantage of thin panels is that normally only one side is available as the front or visible face.

It will be apparent that when the support panels 2 and 3 are connected to the panel 1 portions of the panels 2 and 3 extend to the rear of the panel 1 and also somewhat beyond the front face 4. The latter is for decorative purposes. The supports provide for the panel 1 to stand upright on the floor.

The panel 1 is provided with several cutouts which are adapted to hold plastic display trays. For example, the cutout 12 receives and holds the tray 13.

The trays 14, 15 and 16 are supported in cutouts not shown. In this particular display, the trays 13 and 14 are the same size and have the same size cutout. The trays 15 and 16 are each approximately double the size of the trays 13 and 14 and are disposed in appropriately sized cutouts.

The tray 13 has a bottom 17 which is biased toward the front side and has a rail 18. The bottom 17 and the rail 18 serve as a means for holding the shoes 19. The trays 14, 15 and 16 also have means for holding the display merchandise. The tray 14 has a flat bottom 20 for holding the books 21. The tray 15 is shallow and has a steep, biased bottom 22 provided with clips not shown for holding the ties 23. The tray 16 has several compartments 24 each of which has a small hanger or nose not shown for supporting the eye ware 35.

The configuration of the trays 13, 14, 15 and 16 is exemplary and will serve to illustrate the wide variety of configurations of trays for displays of merchandise of all types.

The trays are formed by conventional plastic molding techniques and are made of standard material such as polypropolene or polyethylene, so that an almost infinite variety of sizes, shapes and article support means are possible.

Preferably the trays are translucent so that they may be illuminated by light source set up on the rear of the panel. As shown in FIG. 1 the light panel 29 is adapted to be fastened between the supports 2 and 3 by fasteners 30 which are the same as fasteners 7. Panel 29 carries four lighting fixtures and bulbs 31. In lieu of a panel such as 29 the light sources may be set up on the wall or other building component which is fronted by the display unit.

Figure 3:
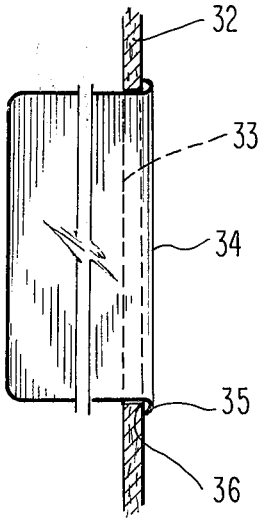
FIG. 3 is a sectional view illustrating how a display tray is arranged in the cutout of a panel.

The invention contemplates that the outside dimensions of the tray and the dimensions of the cutout be coordinated so that the tray can be pushed into place and is press fitted in its desired position. Thus the wall of the tray bears firmly on the cutout so that the tray is held firm with sufficient force to maintain same when loaded with merchandise but which will permit the tray to be pulled and/or pushed out in the reverse direction. This is illustrated in FIG. 3 wherein the panel 32 has a cutout 33 holding the tray 34. While it is not shown in FIG. 3 I contemplate that the trays be molded so that the side facing the lower part of the cutout has a raised detent which will bear on the edge of the cutout when the panel is positioned and aid in maintaining the panel in position.

The means for correctly positioning the tray in the cutout (the innermost position) comprises an integral bezel 35 which engages the peripheral edge 36 of the cutout. The bezel additionally serves as a decorative member. Referring back to FIG. 1, the tray 13 has bezel 37 and the trans 14–16 have similar bezels.

The top of the basic display unit D-1 of FIG. 1 when standing against the wall extends far above the eye level of the great majority of persons and far above the top display tray. The focus of attention is on the displays and on the decorated or colored panels. The wall above the unit goes relatively unnoticed. Thus, the unit serves both as a display and as a simulated wall. The lack of attention to the wall above the unit permits the same to be finished in the most inexpensive way.

Several of the units of FIG. 1 may be arranged in a side-by-side fashion along a wall or arranged at angles to one another such as at a corner. Units may be dispersed above a display area both singularly and/or in groups either in-line or angled or back to back. Thus the adaptability in single or multiple groups with a variety of angular orientations becomes a substitute for expensive display cases and provides the capability for more attractive and innovative displays and permits the display of a greater variety of different types of merchandise in much smaller areas.

So too the display trays are easily pushed in and out and the type of merchandise to be shown can be changed to suit the circumstances. Change-over time is minimal.

Figure 4:
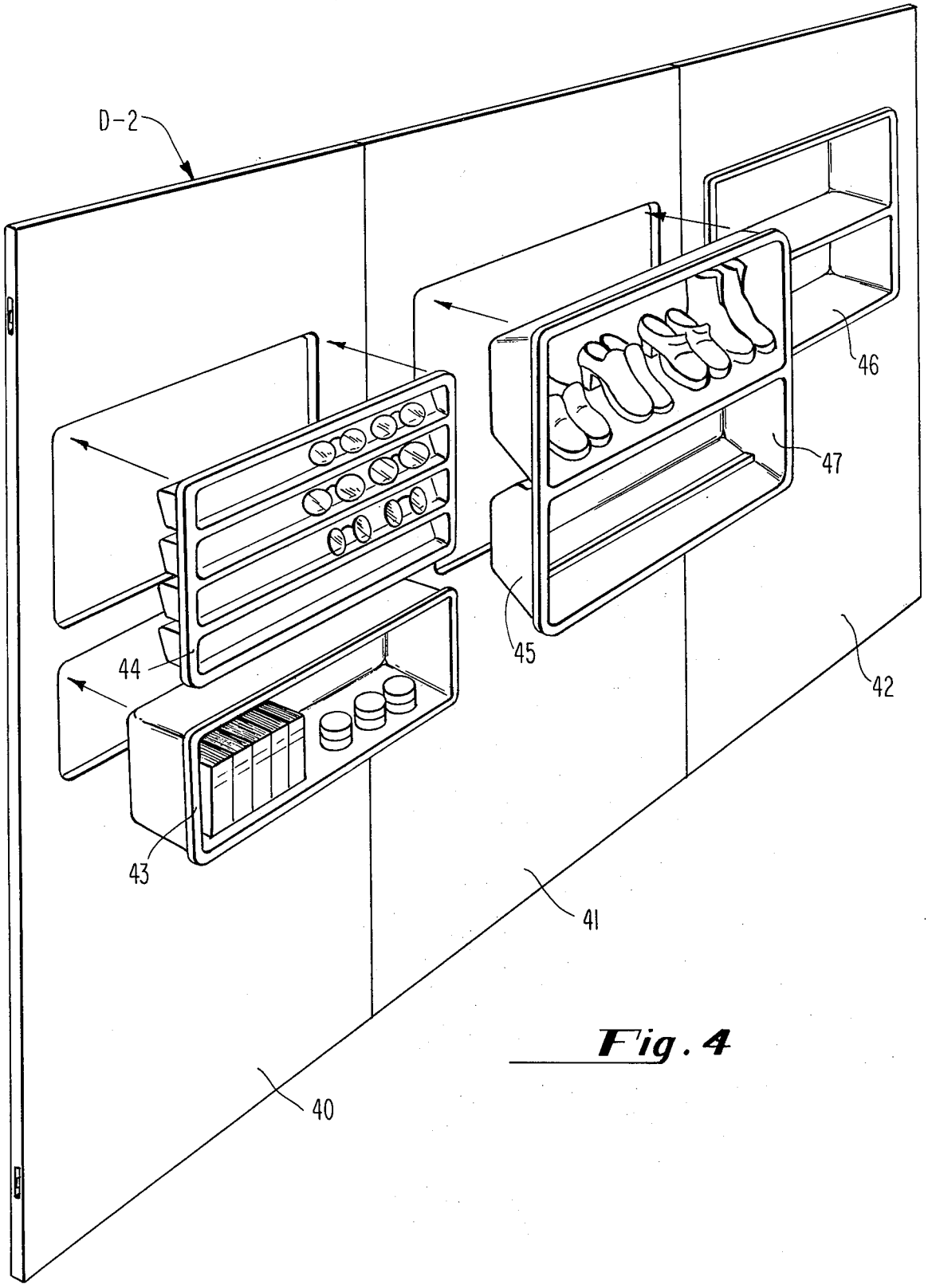
FIG. 4 is a partially exploded view illustrating a three panel side-by-side arrangement.

Another way of arranging the units of FIG. 1 is illustrated by the unit D-2 shown in FIG. 4. The panels 40, 41 and 42 have the same structure as the panel 1 except for the cutouts and the corresponding trays 43, 44, 45 and 46. Note that the trays 44, 45 and 46 have a configuration different from the trays shown in FIG. 1.

When three panels are secured side by side as shown it is preferred that a support (such as support 3 or 4) be connected to the end of every third panel; for example, at the end of panel 42. This is to provide stability for the assembly.

Figure 5:
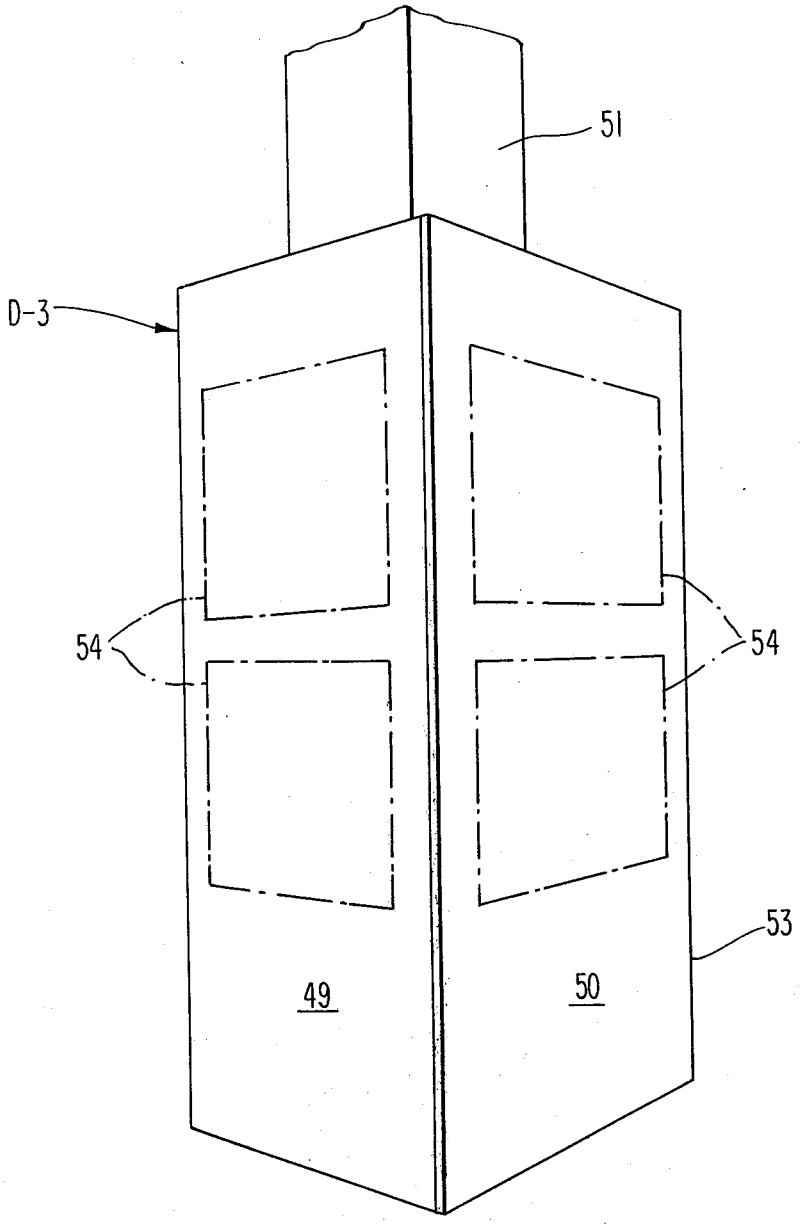
FIG. 5 is a perspective view of a rectangular display.

In FIG. 5 I have shown display unit D-3 which illustrates a typical arrangement of panels used for concealment of columns or pillars while providing display capabilities in the column area. Moreover, the display unit of FIG. 4 can simply be free standing on the floor where it serves the display function only.

The panels 49 and 50 are arranged at right angles to one another adjacent the column 51. The panels are clipped together by fasteners the same as fastener 7 with the routed-out section being made in the edge of one of the panels and the shouldered screw being fastened to the abutting face of the other. The visible edges 53 of the panel 50 are decorated or finished compatably with the decor. Two identical panels not shown are on the opposite side of the column 51. The trays for the panels are indicated by the dotted lines 54.

Figure 6:
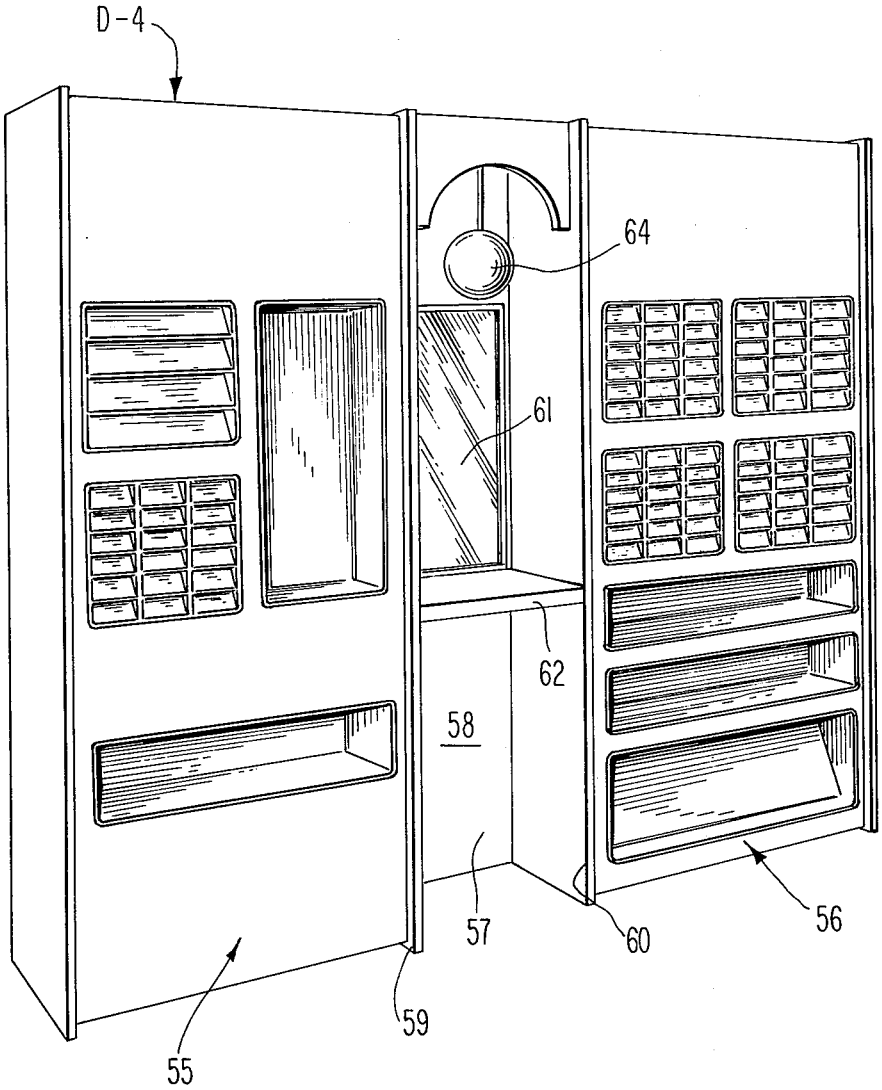
FIG. 6 is a perspective view of a multiple display units of the invention in association with a compatible functional fixture.

In FIG. 6 I have illustrated a display unit D-4 which further illustrates the versatility of the invention. Here the units 55 and 56 are interconnected to an intermediate unit 57.

The units 55 and 56 are the same as those shown in FIG. 1 except for the type of display trays. The intemediate unit 57 has a back wall 58 which is connected to the support panels 59 and 60 by fasteners the same as to fastener 7. The wall carries a mirror 61 and a shelf 62. A light means 64 is provided over the mirror.

I claim:

1. In a display and/or storage unit:

a flat, elongated, generally rectangular main panel to be supported in an upright position, the panel having a front and a rear face and at least one face including decorative surfacing;

a plurality of cutout sections in said main panel;

a plurality of display trays respectively disposed in said cutouts, each said tray having a bezel extending around its edge;

each tray having exterior dimensions providing that the tray can be pushed into its cutout so that said bezel engages the peripheral area of the cutout to establish the innermost position of the tray and in said position the exterior dimensions providing for the tray to be firmly engaged with its cutout, the engagement securing the tray in position but providing for the tray to be pulled and/or pushed out in the opposite direction; and means in each tray for supporting an article for display or storage.

2. In a display and/or storage unit:

a flat, elongated, generally rectangular main panel to be supported in an upright position, the panel having a front and a rear face and at least one face including decorative surfacing;

at least one cutout section in said main panel;

a display tray disposed in said cutout, the tray having a bezel extending around its edge;

the tray having exterior dimensions providing that the tray can be pushed into the cutout so that said bezel engages the peripheral area of the cutout to establish the innermost position of the tray and in said position the exterior dimensions providing for the tray to be firmly engaged with the cutout, the engagement securing the tray in position but providing for the tray to be pulled and/or pushed out in the opposite direction; and means in the tray for supporting an article for display or storage.

3. A composite merchandise display device and simulated building wall unit comprising:

a plurality of flat, elongated, generally rectangular panels to be supported in an upright position and arranged side by side and joined together along abutting edges, each panel having a front and a rear face and at least one face including decorative surfacing;

means releasably joining the panels together;

means supporting the panels in an upright position;

a plurality of cutout sections respectively disposed in some of said panels;

a plurality of disposable trays respectively disposed in said cutouts, each tray having a bezel extending around its edge;

each tray having exterior dimensions providing that the tray can be pushed into its cutout so that said bezel engages the peripheral area of the cutout to establish the innermost position of the tray and in said position the exterior dimension providing for the tray to be firmly engaged with its cutout, the engagement securing the tray in position but providing for the tray to be pulled and/or pushed out in the opposite direction; and means in each tray for supporting an article of merchandise for display.

4. The unit of claim 3 where the panels lie in the same plane.

5. The unit of claim 3 wherein at least one pair of adjacent panels are oriented at substantially 90°.

6. A composite merchandise display device and simulated building wall unit comprising:

a flat, elongated, generally rectangular main panel for standing upright on a floor, the panel having a front and a rear face at least one face including a decorative surfacing;

a pair of side supports disposed respectively along the opposite lengthwise edges of the main panel and standing upright on the floor, each support comprising a flat panel extending normally to the main panel and extending away from the front and away from the rear of the main panel to provide vertical support for the main panel;

means releasably connecting each side panel to the main panel;

a plurality of cutout sections in the main panel;

a plurality of display trays respectively disposed in said cutouts, each tray having a bezel extending around its edge;

each tray having exterior dimensions providing that the tray can be pushed into its cutout so that said bezel engages the peripheral area of the cutout to establish the innermost position of the tray and in said position the exterior dimensions providing for the tray to be firmly engaged with its cutout, the engagement securing the tray in position but providing for the tray to be pulled and/or pushed out in the reverse direction; and means in each tray for supporting an article of merchandise for display.

* * * * *